US005844765A

United States Patent [19]

Kato et al.

[11] Patent Number: 5,844,765

[45] Date of Patent: Dec. 1, 1998

[54] POWER PLUG WITH A SLIDABLE LID COVERING A CIRCUIT PROTECTOR RESET KNOB

[75] Inventors: Tatsuo Kato, Maebashi; Shigeo Kato, Isesaki; Eiichi Hashimoto, Isesaki; Junichi Suda, Isesaki, all of Japan

[73] Assignee: Hosiden Corporation, Osaka, Japan

[21] Appl. No.: 956,359

[22] Filed: Oct. 23, 1997

[30] Foreign Application Priority Data

Oct. 25, 1996 [JP] Japan ..... 8-283899

[51] Int. Cl.[6] ..... H01H 73/00

[52] U.S. Cl. ..... 361/115; 361/93

[58] Field of Search ..... 361/42, 88, 93, 361/103, 105, 115; 335/16, 152, 195, 202; 200/51.1, 51.12, 16, 52.12

[56] References Cited

U.S. PATENT DOCUMENTS 4,307,925 12/1981 Drew ..... 339/147

4,592,613 6/1986 Tong ..... 339/147

5,644,464 7/1997 Zhou ..... 361/115

*Primary Examiner*—Jeffrey Gaffin

*Assistant Examiner*—Kim Huynh

*Attorney, Agent, or Firm*—Pollock, Vande Sande & Priddy

[57] ABSTRACT

In a circuit-protector-built-in power plug, the plug body has in its front a curved concavity, in which plug terminals are planted, a circuit protector which interrupts the circuit when supplied with excess current, and a reset knob for resetting the circuit to its closed state through manipulation from the outside the plug body. The reset knob is so disposed in the concavity that it does not protrude beyond the surface of the plug body. A slidable lid covering the concavity prevents access to the reset knob when the plug terminals are inserted into receptacles.

1 Claim, 8 Drawing Sheets

POWER PLUG WITH A SLIDABLE LID COVERING A CIRCUIT PROTECTOR RESET KNOB

BACKGROUND OF THE INVENTION

The present invention relates to a power plug which has a built-in circuit protector operative to interrupt the current to the load upon occurrence of excess current.

To prevent burning or similar accidents of electrical machinery and apparatus and lead wires (plug cords) by excess current, there has been proposed a power plug with a built-in circuit protector. FIG. 1 shows a conventional power plug structure of this kind. A description will be given first. with reference to FIGS. 2A and 2B, of a circuit protector 11 built in the power plug.

Projecting out from the inside of an insulator case 12 through one side wall thereof are a pair of terminals 13 and 14, the inner end of the terminal 13 forming a fixed contact 15. The terminal 14 has its inner end connected to one end of a sheet-like movable spring 16 made of bimetal, which has at its free end portion a movable contact 17 opposite the fixed contact 15. The movable spring 16 has its free end held in engagement with one end of a semielliptic spring 18, the other end of which is locked in a recess 19 made in the inner wall of the case 12. In FIG. 2A, the movable spring 16 is shown to be pressed by the semielliptic spring 18 toward the terminal 13, with the movable contact 17 pressed against the fixed contact 15.

A reset knob 21 is mounted on the case 12, with the inner end of the knob 21 opposed to the movable spring 16 on the side opposite to the fixed contact 15 and the outer end portion sticking out of the case 12. Inserted between a flange at the inner end of the reset knob 21 and the inner wall of the case 12 is a coil spring 22, by which the reset knob 21 is held at the position shown in FIG. 2A. In FIGS. 2A and 2B, reference numeral 23 denotes a cover of the case 12 and 24 eyelets.

In the circuit protector 11, the terminals 13 and 14 are connected in series to the current path and a current flows across the terminals 13 and 14 via the fixed contact 15, the movable contact 17 and the movable spring 16. Upon occurrence of an excess current, the movable spring 16 warps to displace its free end in a direction to separate it from the fixed contact 15 and the movable spring 16 is instantaneously pulled up, that is, the movable contact 17 is disengaged from the fixed contact 15, resulting in the current being interrupted. At this time, the reset knob 21 is pushed out of position by the movable spring 16 and held there.

Upon depressing the reset knob 21 when the movable spring 16 has cooled, the spring 16 is pressed down into position with the movable contact 17 urged against the fixed contact 15, resetting the circuit protector 11 to its initial state.

The circuit protector 11 of such a structure as mentioned above is housed in a plug body 25 to form a power plug 26 as shown in FIG. 1. Incidentally, those portions of the terminals 13 and 14 projecting out of the case 12 are removed. The reset knob 21 is inserted through the plug body 25 and projected out onto its one side so that the knob 21 can be pressed from outside.

The plug body 25 has a pair of plug terminals 27 and 28 projected out of its front and a plug cord 29 secured to its rear end through a bush 31. The plug cord 29 has its one lead wire 32 connected to the plug terminal 27 and its other lead wire 33 connected to the terminal 13. The terminal 14 and the plug terminal 28 are electrically connected to form the power plug 26 with the circuit protector 11 built-in.

In the above-described conventional power plug 26 with the circuit protector 11 built-in, when the circuit protector 11 operates on an excess current, the reset knob 21 is pushed out; hence, the circuit protector can easily be reset from outside simply by depressing the reset knob 21.

In the conventional power plug 26, however, the reset knob 21 is protrusively provided on one side of the plug body 25, and hence it can be pressed even if the plug terminals 27 and 28 are plugged in mating receptacles. On this account, there is a risk that, for example, when the power plug 26 is removed from the receptacles, the circuit protector 11 is reset by inadvertent pressing of the reset knob 21 so that the excess current can flow again.

SUMMARY OF THE INVENTION

It is therefore an object of the present invention to provide a power plug having a circuit protector built-in which, when the plug terminals are being inserted in the receptacles, prohibits the reset knob from being pressed, that is, prevents the circuit protector from being reset, thereby providing improved safety.

The power plug according to a first aspect of the present invention comprises a plug body having plug terminals protruding from its front in the direction in which to insert the plug terminals into receptacles, induces a circuit protector disposed in the plug body which breaks a circuit when supplied with excess current, and has a reset knob for resetting the circuit to its closed state by manipulation from the outside. The reset knob is disposed in a concavity formed in a surface of the plug body so that it does not protrude through a plane containing the surface.

In the plug according to the first aspect of the invention, the concavity is formed by a curved surface made in the front of the plug and the plug terminals protrude from the curved surface.

According to a second aspect of the present invention, in the power plug according to the first aspect of the invention, a lid is retractably mounted on the plug body for covering the concavity to shield the reset knob from the outside, and the lid has a portion which, when it is brought to it uncovering position, protrudes forwardly of the front of the plug body to hold the lid at its covering position when the plug terminals are inserted in said receptacles.

BRIEF DESCRIPTION OF THE DRAWINGS

FIG. 1 is a diagram for explaining a conventional power plug with a circuit protector built-in;

DETAILED DESCRIPTION OF THE PREFERRED EMBODIMENTS

Figure 1:
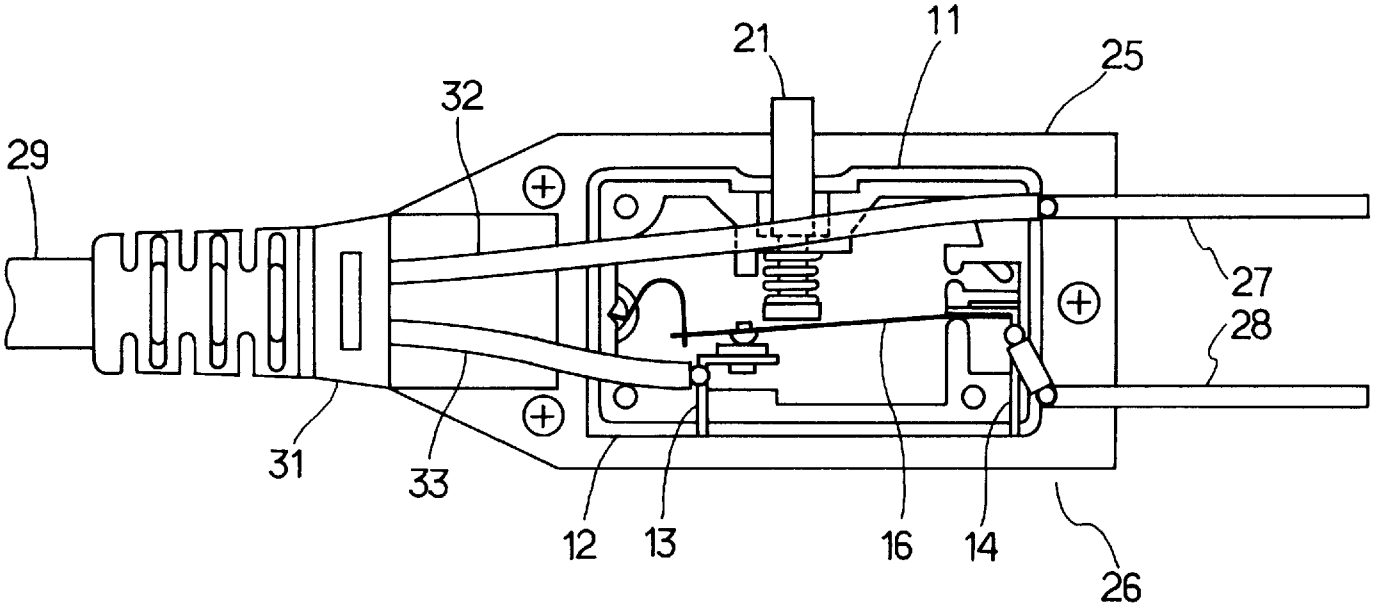
FIG. 1 PRIOR ART
Figure 2A:
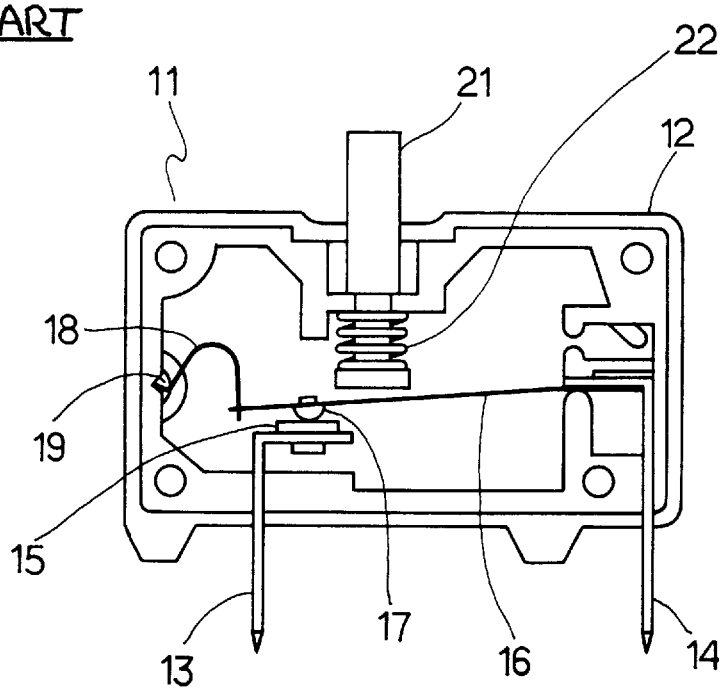
FIG. 2A PRIOR ART
FIG. 2A is a sectional view for explaining the construction of the built-in circuit protector in FIG. 1.
Figure 2B:
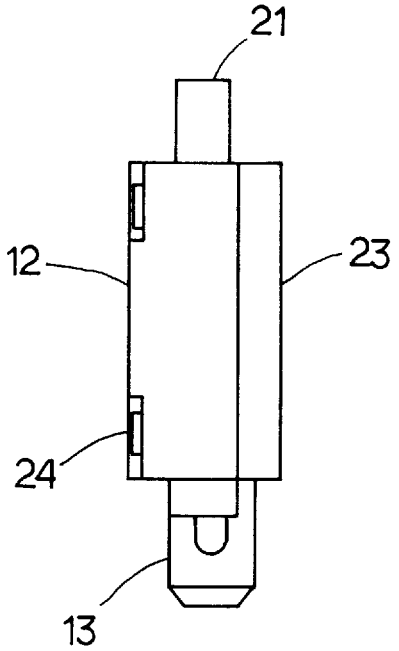
FIG. 2B PRIOR ART
FIG. 2B is a side view showing its external appearance.

With reference to FIGS. 3 through 8, embodiments of the present invention will hereinafter be described. The parts corresponding to those in FIGS. 1, 2A and 2B are identified by the same reference numerals and no description will be repeated thereon.

Figure 3A:
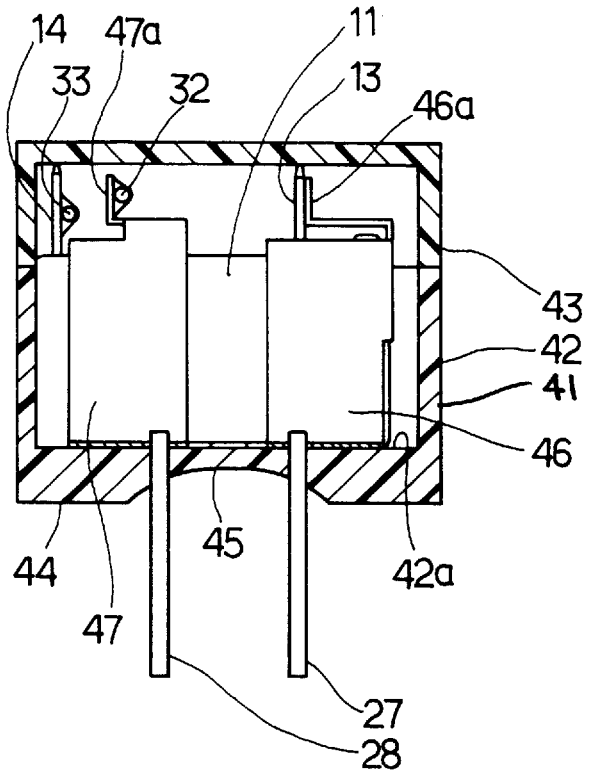
FIG. 3A is a sectional view illustrating a first embodiment of the present invention.
Figure 3B:
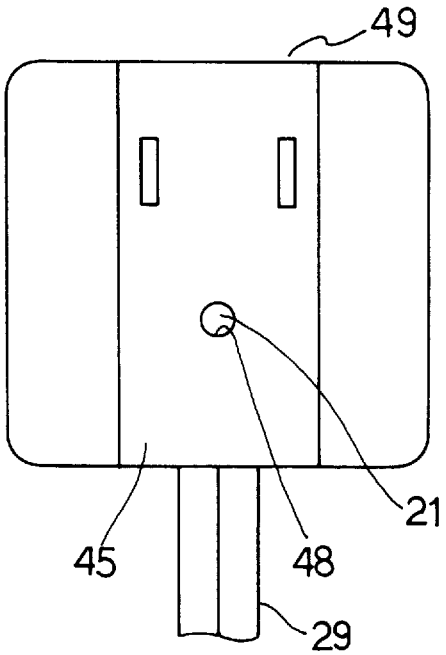
FIG. 3B is a front view of the first embodiment shown in FIG. 3A.
Figure 3C:
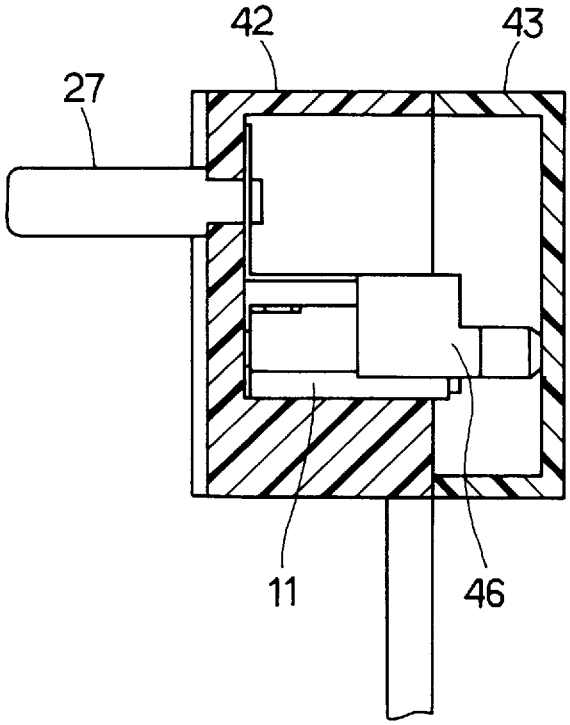
FIG. 3C is a sectional view, partly cut away, of the first embodiment.

FIGS. 3A, 3B and 3C are horizontal sectional, front and vertical sectional views of a first embodiment of the present invention, respectively. The plug body, indicated generally by 41, is a substantially box-shaped member composed of a case 42 and a cover 43 and having a concavity 45 formed in its front 44. In this example the concavity 45 is formed by a cylindrically curved surface extending from the upper to lower side of the front 44.

The pair of plug terminals 27 and 28 are protruded from the concavity 45 formed in the front 44, their inner ends having fixedly secured thereto metallic contact pieces 46 and 47 in the plug body 41, respectively.

One side portion of the contact piece 46 is pressed against the inner wall 42*a* of the case 42 and joined to the plug terminal 27, and the other side portion is bent toward the cover 43 and extended rearward and its top end portion is bent inwardly and further bent rearward to form a contactor 46*a* as shown in FIG. 3A. Similarly, the contact piece 47 also has one side portion pressed against the inner wall 42*a* of the case 42 and joined to the plug terminal 28 and has its other side portion bent rearward to form a contactor 47*a* at its rear end.

Disposed in the plug body 41 is, in this example, the same circuit protector 11 as that shown in FIG. 2A. The circuit protector 11 is housed in the case 42 with the front end face of the reset knob 21 held opposite the inner wall 42*a* of the case 41 but allowed to protrude from the plug body 41 through a hole 48 made in the case 42. The hole 48 is open to the concavity 45 so that the reset knob 21 is confined in the concavity 45. Incidentally, the terminal 13 of the circuit protector 11 and the contactor 46*a* of the contact piece 46 are soldered together.

The plug cord 29 is disposed on the underside of the plug body 41 and has its lead wire 32 connected by soldering to the contactor 47*a* of the contact piece 47 and the other lead wire 33 connected to the terminal 14 of the circuit protector 11. Accordingly, the lead wire 32 is connected via the contact piece 47 to the plug terminal 28 and the lead wire 33 is connected to the circuit protector 11 and the plug terminal 27 via the contact piece 46.

Figure 4A:
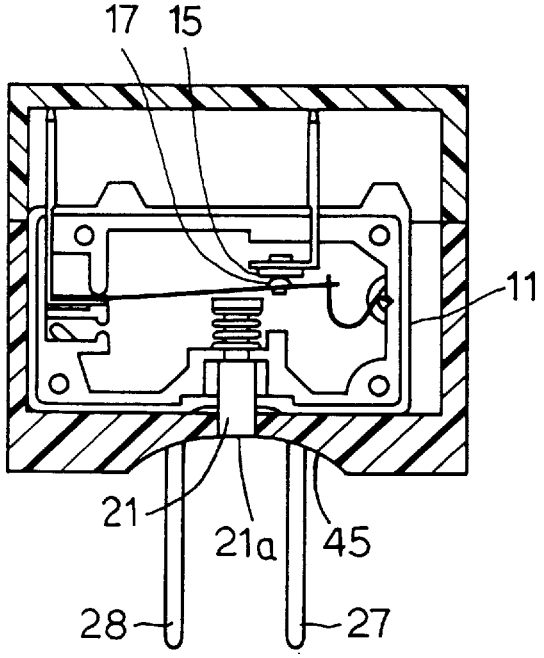
FIG. 4A is a diagram showing a circuit-making state of the circuit protector of the power plug of FIG. 3.
Figure 4B:
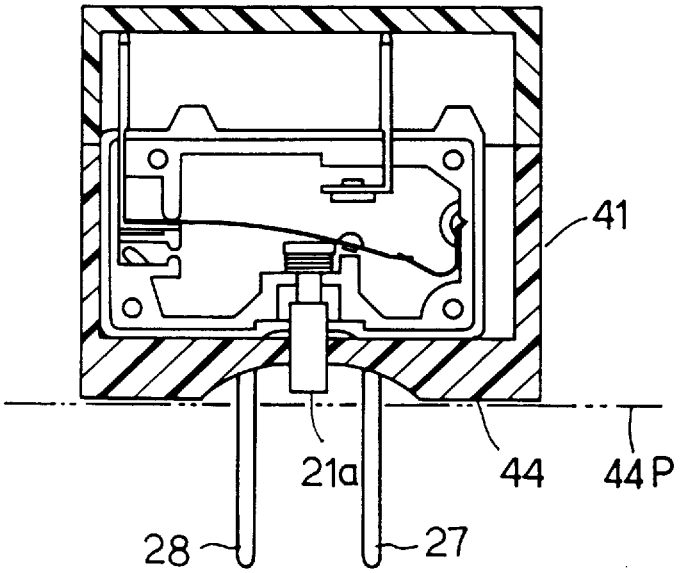
FIG. 4B is a diagram showing a circuit-breaking state of the circuit protector.

The reset knob 21 is placed so that its front end face 21*a* lies at such positions as shown in FIGS. 4A and 4B. That is, when the fixed contact 15 of the circuit protector 11 and the movable contact 17 are held in contact with each other and the circuit is closed, the front end face 21*a* of the reset knob 21 is substantially flush with the curved surface of the concavity 42 as depicted in FIG. 4A. On the other hand, when the circuit protector 11 is operated by an overcurrent and the circuit is interrupted, the reset knob 21 is pushed out but its front end face 21*a* does not protrude beyond the broken-lined plane 44P containing the front 44 of the plug body 41. In other words, the reset knob 21 is placed so that its movement will not be limited by the receptacles into which the plug terminals 27 and 28 are inserted.

With the circuit protector built-in power plug 49 of such a construction as described above, the reset knob 21 cannot be pressed unless the plug 49 is removed from the mating receptacle, that is, the circuit protector 11 cannot be reset—this eliminates the possibility of resetting the circuit protector 11 while leaving it in a state in which power is applied thereto and an overcurrent flows therethrough.

Figure 5:
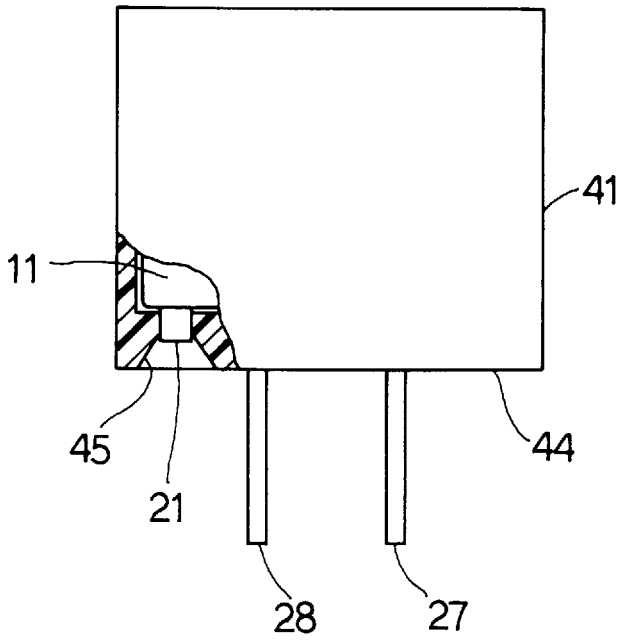
FIG. 5 is a sectional view, partly cut away, illustrating a second embodiment of the present invention.

The reset knob 21 need not always be placed at the center of the front 44 of the plug body 41 as shown in FIGS. 3A, 3B, 4A and 4B, but it may also be disposed at such a position as shown in FIG. 5 by changing the position of placement of the circuit protector 11 in the plug body 41 or changing the construction of the reset knob 21. In this example, the concavity 45 is made dish-like.

If the power plug is left unremoved from the receptacle for a long time, dust collects between the plug and the receptacle and around the plug terminals; when the dust absorbs moisture, the plug terminals readily conduct therebetween and, for example, leakage current flow causes fire.

In the power plug 49 shown in FIGS. 3A and 3B, since the plug terminals 27 and 28 protrude from the concavity 45 formed by the curved surface, dust is effectively prevented from collecting, and since the distance between the plug terminals 27 and 28 along the curved surface is long, the generation of leakage current is suppressed. In this respect, too, the power plug of this embodiment provides greater safety. In FIGS. 3A and 3B, the concavity 45 is formed by a cylindrically curved surface, but it is not limited specifically thereto and may also be formed, for example, by a spherical, truncated conical or V-shaped groove surface.

Figure 6A:
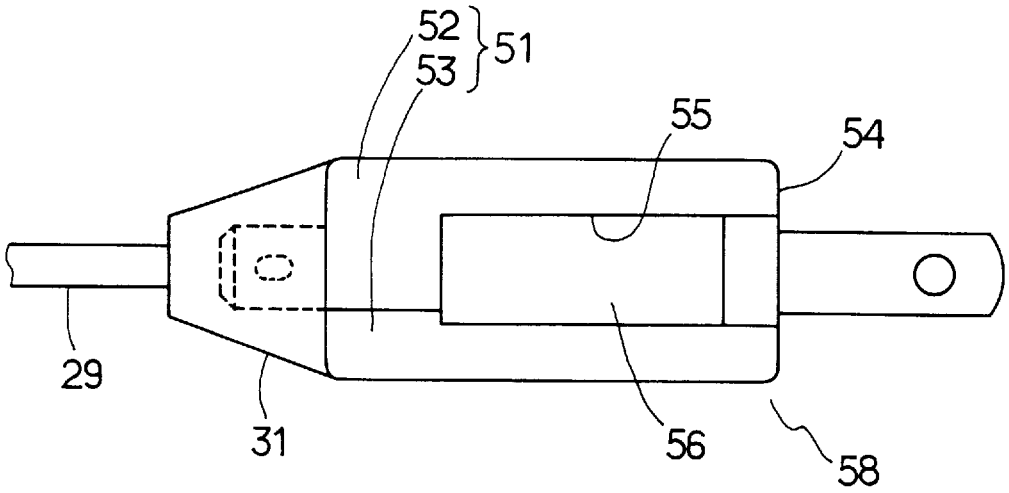
FIG. 6A is a side view of the second embodiment.
Figure 6B:
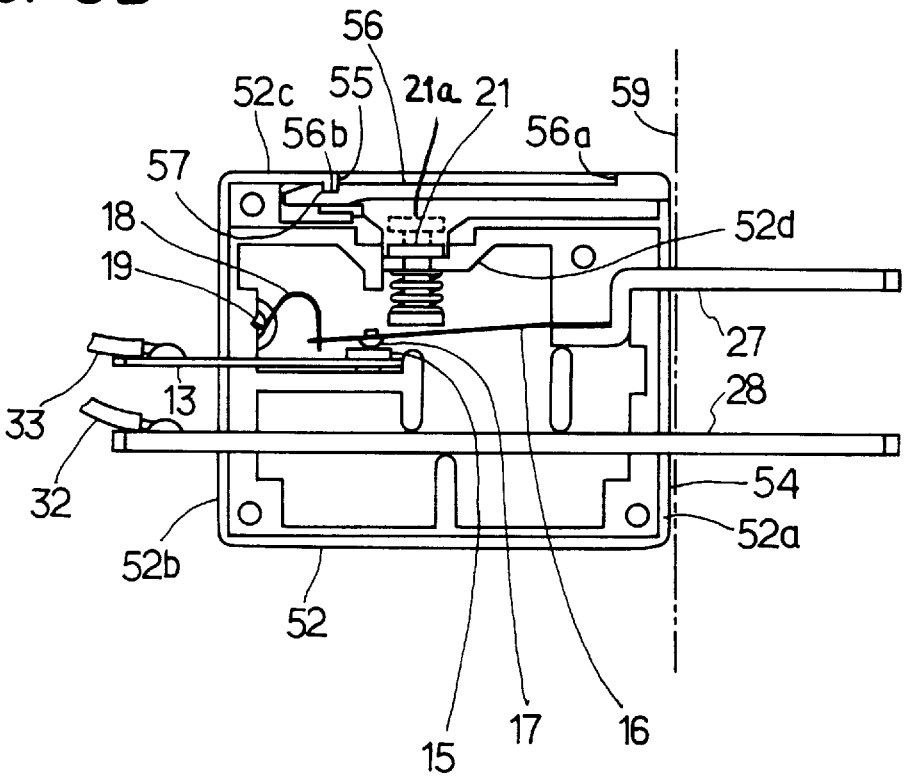
FIG. 6B is a diagram illustrating the internal structure of the second embodiment.

Turning next to FIGS. 6A and 6B, an embodiment according to the second aspect of the present invention will be described. In this embodiment, the parts forming the circuit protector 11 are housed in the plug body 41, that is, the case 52 and cover 53 of the plug body 51 are used also as the case and cover of the circuit protector 11. FIG. 6B is a bottom view of the case 52 with the cover 53 removed, showing the internal construction of the power plug in FIG. 6A.

The pair of plug terminals 27 and 28 are planted on the front wall 52*a* of the case 52 and protruded from the front 54 of the plug body 51. The plug terminal 28 is extended through the case 52 with the extended end protruding from the rear wall 52*b* of the case 52. The inner end of the plug terminal 27 has fixed thereto one end of the movable spring 16, and the fixed contact 15 lies opposite the movable contact 17 formed near the free end of the spring 16. The fixed contact 15 is formed at the inner end of the terminal 13 planted on the rear wall 52*b* of the case 52. The semielliptic spring 18 is placed between the recess 19 made in the inner surface of the rear wall 52*b* and the free end of the movable spring 16, by which the movable contact 17 is pressed against the fixed contact 15.

The reset knob 21 is secured to a partition wall 52*d* provided along and inside the side wall 52*c* of the case 52, with the inner end of the reset knob 21 held opposite the movable spring 16. The reset knob 21 is pushed out by the reversal of the movable spring 16, but its front end face 21*a* is held between the side wall 52*c* and the partition wall 52*d* as indicated by the broken line 59 in FIG. 6B. In the side wall 52*c* of the case 52 there is formed an opening 55, which is covered with a lid 56 secured to the case 52. That is, the lid 56 is provided on one side of the plug body 51 to shield the reset knob 21 from the outside.

Figure 7:
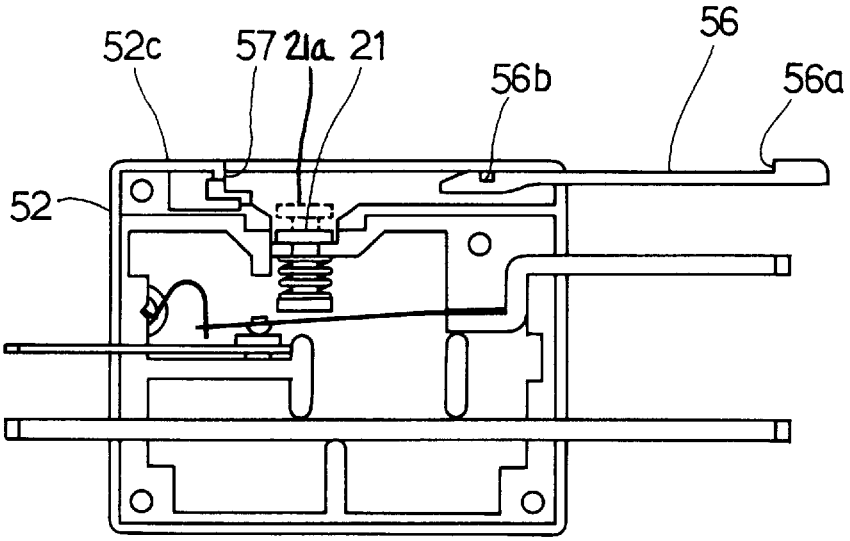
FIG. 7 is a diagram for explaining the state in which the power plug shown in FIGS. 6A and 6B is uncovered.

The lid 56 in this example is of the type that opens and shuts the opening 55 by being slid in the direction in which the plug terminals 27 and 28 are inserted into and removed from receptacles, and when the lid 56 is pulled out to its outermost position, it protrudes forwardly of the front 54 of the plug body 51. The lid 56 has a stepped portion 56*a* formed therein near its protruding end so as to facilitate its easy sliding movement to the outermost position and a groove 56*b* cut in its other end portion for engagement with a projection 57 formed on the inner surface of the side wall 52*c* of the case 52. FIGS. 6A and 6B shows the state in which the opening 55 is covered with the lid 56 held at its retracted position, whereas FIG. 7 shows the state in which the opening 55 is uncovered with the lid 56 held at its pulled-out position. In FIG. 6B, disengaging the groove 56*b* from the projection 57 by pressing the side of the lid 56 and sliding it by pulling the stepped portion 56*a* in the direction in which to insert the plug into the receptacles, the reset knob 21 is exposed to the outside as shown in FIG. 7 so that it can be pressed to reset the circuit protector 11.

The plug cord 29 is attached to the rear end of the plug body 51 through the bush 31 as shown in FIGS. 6A and 6B. The lead wire 32 is connected to the plug terminal 28 and the lead wire 33 is connected to the terminal 13. By this, the circuit protector is connected between the plug terminal 27 and the lead wire 33.

As is evident from FIGS. 6A, 6B and 7, according to this embodiment of the power plug 58 with the circuit protector built-in, when the plug terminals 27 and 28 are inserted in receptacles, the lid 56 is held at its retracted position to cover the opening 55; hence, the reset knob 21 cannot be pressed. That is, it is only when the power plug 58 is off the receptacles that the lid 56 can be moved to expose reset knob 21 so that the reset knob 21 can be pressed to reset the circuit protector.

Figure 8A:
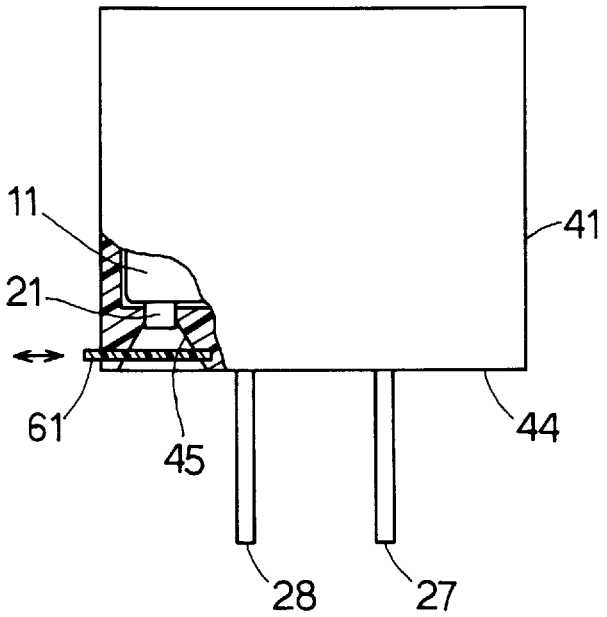
FIG. 8A is a sectional view, partly cut away, illustrating a modified form of the present invention.
Figure 8B:
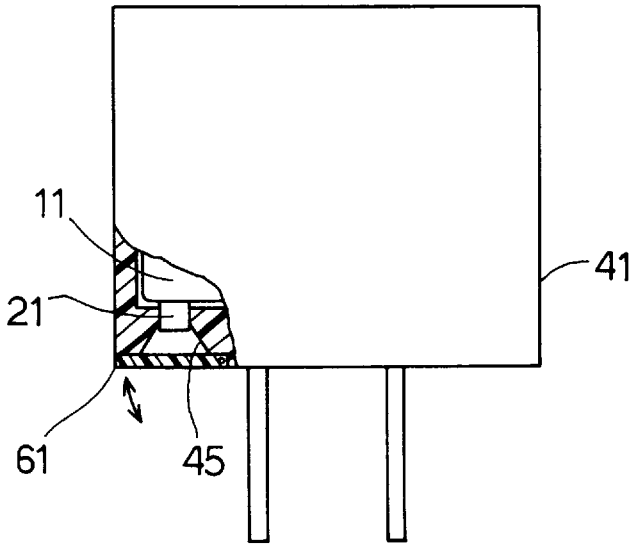
FIG. 8B is a diagram showing another modified form of the present invention.

FIGS. 8A and 8B illustrate modified forms of the power plug of FIG. 5, in which a lid 61 is additionally provided. In FIG. 8A, the lid 61 is adapted to slide in the direction of the arrow, whereas in FIG. 8B it turns in the direction of the arrow. With such arrangements, there is no risk of inadvertent pressing of the reset knob 21.

EFFECT OF THE INVENTION

As described above, according to the circuit-protector-built-in-power plug of the present invention, since the reset knob, for resetting a circuit protector operated by excess current, has a structure that prevents it from being pressed unless the plug is removed from the receptacles, it is possible to prevent erroneously resetting the circuit protector while excess current is still flowing thereacross. Accordingly, the circuit-protector-built-in power plug of the present invention has greater safety than conventional power plugs of this kind.

It will be apparent that many modifications and variations may be effected without departing from the scope of the novel concepts of the present invention.

What is claimed is:

1. A power plug having a built-in circuit protector, comprising a plug body having plug terminals extending outwardly from a front surface of said body in the direction in which said plug terminals are to be inserted into receptacles;

a circuit protector disposed in said plug body, said circuit protector being operative to open a normally closed circuit within said plug body when supplied with excess current and having a reset knob for resetting said circuit to its closed state by manipulation of said reset knob from the outside of said plug body;

said reset knob being disposed in a concavity formed in a side surface of said plug body that is transverse to said front surface, said reset knob being so arranged that it does not protrude from said concavity beyond a plane containing said side surface;

a lid retractably mounted on said side surface of said plug body for slidable movement in a direction parallel to the direction of extension of said plug terminals, said lid being movable between a first position in which it covers said concavity to make said reset knob inaccessible and a second position in which said concavity is uncovered to make said reset knob accessible for manipulation, said lid having a portion which, when said lid is in said second position, extends forwardly of said front surface of said plug body adjacent said plug terminals and which functions, when said plug terminals are being inserted into receptacles, to engage a surface adjacent the receptacles so as to move said lid back to said first position and to hold said lid in said first position covering said concavity, whereby said reset knob is inaccessible for manipulation when said plug terminals have been inserted into receptacles.

* * * * *